United States Patent [19]

Drobot

[11] Patent Number: 4,817,495

[45] Date of Patent: Apr. 4, 1989

[54] DEFENSE SYSTEM FOR DISCRIMINATING BETWEEN OBJECTS IN SPACE

[75] Inventor: Adam T. Drobot, Annandale, Va.

[73] Assignee: APTI, Inc., Los Angeles, Calif.

[21] Appl. No.: 883,223

[22] Filed: Jul. 7, 1986

[51] Int. Cl.[4] ..... G01N 23/00; H05C 3/00

[52] U.S. Cl. ..... 89/1.11; 250/310; 250/358.1

[58] Field of Search ..... 250/306, 358.1, 310; 324/464; 328/1; 89/1.11, 1.1

[56] References Cited

U.S. PATENT DOCUMENTS

| | | | |
|---|---|---|---|
| 3,327,124 | 6/1967 | Plum | 250/306 |
| 4,320,298 | 3/1982 | Buford et al. | 250/358.1 |
| 4,393,311 | 7/1983 | Feldman et al. | 250/310 |
| 4,412,967 | 11/1983 | Winterberg | 89/1.11 |
| 4,686,605 | 8/1987 | Eastlund | 89/1.11 |

OTHER PUBLICATIONS

"Particle Beam Weapons", Parmentola et al., 4/79, pp. 54–65, Scientific American, vol. 240, #4.

"Radiation Backscattering . . . Structure", Berk, S.; pp. 309–312, Materials Evaluations, vol. 24, #6, 6/66.

"Space-Based Ballistic-Missile Defense", Bethe et al., 10/84, pp. 39–49, Scientific American, vol. 251, #4.

*Primary Examiner*—Nelson Moskowitz

*Attorney, Agent, or Firm*—Drude Faulconer

[57] ABSTRACT

A defense system and a method for discriminating between armed re-entry vehicles and unarmed objects which are in close proximity of each other. The re-entry vehicles and the unarmed objects are bathed in a cloud of relativistic electrons with the resulting signatures from heavy objects, i.e., re-entry vehicles, being imaged directly. Detectors sense the location and identify of the re-entry vehicles and passes this information onto a weapons platform for tracking and interception.

14 Claims, 2 Drawing Sheets

DEFENSE SYSTEM FOR DISCRIMINATING BETWEEN OBJECTS IN SPACE

DESCRIPTION

1. Technical Field

The present invention relates to a method for discriminating between objects in space and more particularly relates to a defense system which utilizes ground based power to generate relativistic electrons which interact with objects in space to produce identifying signatures from said objects.

2. Background Art

Presently, the expected scenario for any large-scale intercontinental ballistic missile attack includes the deployment of a large number of decoys and penetration aids in a "threat cloud" around one or more armed, re-entry vehicles in an attempt to confuse any defense systems set up to counteract the armed missiles. The decoys and/or penetration aids can be launched simultaneously with the armed vehicles or can be deployed from a separate space-borne vehicle (sometimes called a "bus"). Since the total number of objects expected in a typical threat cloud may well exceed one hundred thousand, any truly effective defense system must include a system which is capable of "interrogating" all of the objects in the threat cloud and quickly discriminating between the deadly re-entry vehicles and the harmless decoys and penetration aids. By doing this, the defense system can ignore the decoys and penetration aids and concentrate all of its countermeasures on destroying or disabling the armed missiles.

In addition to having the ability to distinguish unambiguously between armed and unarmed objects, an effective discrimination system must also be capable of responding quickly to any threat and must be capable of functioning in a nuclear background. Several such systems, both passive and active, have been proposed for this purpose wherein each object in a threat cloud is observed or acted upon in such a way as to produce an identifying signal (hereinafter called a "signature") from that object. These forms which these signatures may take fall into a wide spectrum of different types of signals ranging from radar-like wavelengths to hard x-rays and/or gamma rays and are derived from the objects in a variety of ways, some of which are:

(1) precise determination of orbital dynamics through tracking with radar, optical, or infrared instruments;

(2) differences in skin temperature due to inherent differences in decoy and re-entry vehicle heat capacity, these being based on infrared observations;

(3) active orbit perturbations coupled with orbital dynamics observations (i.e., high power lasers to cause skin ablation);

(4) active energy deposition (i.e., with lasers, hot electrons, etc.) to modify the observable thermal signature; and (5) high power energy deposition to destroy decoys or to alter their trajectory from those of the re-entry vehicles in the threat cloud.

In each of the above systems, a signature of each object in a threat cloud is analyzed to identify that particular object. However, by having to observe and analyze each of the numerous objects in a threat cloud, each of these systems are characterized by the extremely large data flows required and the highly complex decision-making requirements of the battle management system of these defense systems. Accordingly, it is highly desirable to reduce these data flows and to simplify the discrimination of armed vehicles while maintaining the other requirements of an effective defense system.

Still further, previous proposed discrimination systems have all relied heavily on space borne equipment to observe and produce the signatures from the objects to be identified. For example, various beam generators have been proposed which are to be carried aloft by a satellite or the like to focus on and to direct a beam onto an object in a threat cloud to thereby produce a signature from that object. This exposure of such equipment makes it highly vulnerable to damage and makes continuing maintenance of the equipment difficult. Therefore, it can be seen that it is desirable to have as much of the defense system based on the ground as possible where it can be better protected and maintained.

The more conventional discrimination methods, such as differentiation of orbital mechanics, suffer from known countermeasures which block direct viewing of the object under interrogation. Examples of this are chaff to counter radar and sprays or aerosols to produce false infrared signals. The presence of a thermos-like skin may defeat schemes which differentiate on the basis of thermal capacity. It is therefore extremely advantageous to use methods which cannot be countermeasured without severe penalty for the offensive system.

DISCLOSURE OF THE INVENTION

The present invention provides a defense system and a method for detecting re-entry vehicles, discriminating between armed re-entry vehicles and unarmed decoys in close proximity of each other and the detection of re-entry vehicles in the presence of obscurants, which is basically ground-based and which is capable of functioning in possible hostile nuclear background. The basic concept of the present invention is to "bathe" the re-entry vehicles and the unarmed objects in a cloud of relativistic electrons. The resulting radiation signature from each object is such that heavy objects characteristic of the re-entry vehicles can be imaged directly. Detectors located away from the cloud of relativistic electrons sense the location and identity of the re-entry vehicles and passes this information onto a weapons platform or the like for tracking and interception. The present invention greatly reduces the amount of data that has to be handled and the computations required by one to two orders of magnitude since it allows the defense system to deal only with the actual threats.

More specifically, it is advantageous to locate such a discrimination and detection system in the likely corridor for ICBM trajectories, consequently a system could be located in Alaska, and fueled by the natural gas reserves that exist on the North Slope. The gas reserves can then be used to generate large amounts of electricty which, in turn, power a ground-based transmitter to generate electromagnetic (em) radiated energy. This em energy is propagated by ground-based antennae to excite and accelerate electrons which are present in space in the zone of interest. The em energy can be propagated and focused to a desired location in space by proper design of the antennae and there to accelerate electrons by any of several known means, e.g., cyclotron resonance acceleration. This technique can be used to excite electrons in the:

(1) ambient plasma in space to form a cloud of relativistic electrons around all of the objects or to form a stationary shield of relativistic electrons through which the object must travel, or (2) the products which inherently outgas from objects in space to form individual clouds of relativistic electrons around each object.

The electrons are accelerated to energies greater than 5 million electron volts (e.g., 20 Mev) to create relativistic electrons which interact with the materials in the objects to thereby produce x-ray and gamma ray (i.e., photons) signatures from the objects.

A detector means (e.g., photon counting telescope) is positioned at some distance from the relativistic particle cloud and is set at an energy cut-off threshold so that only signatures representative of the heavy, re-entry vehicles will be sensed by the detector. The cut-off threshold will eliminate or ignore the lower energy signatures from the unarmed objects which allows the defense system to concentrate only on the armed vehicles. The detector means can be placed on individual weapons for final homing, in a payload accompanying the kill system which passes in formation to the individual weapons, or in a stand-off detector located far from the target region which passes information for further action to a satellite management system.

BRIEF DESCRIPTION OF THE DRAWINGS

The actual construction, operation, and apparent advantages of this invention will be better understood by referring to the drawings in which like numerals identify like parts and in which.

BEST MODES FOR CARRYING OUT THE INVENTION

Figure 1:
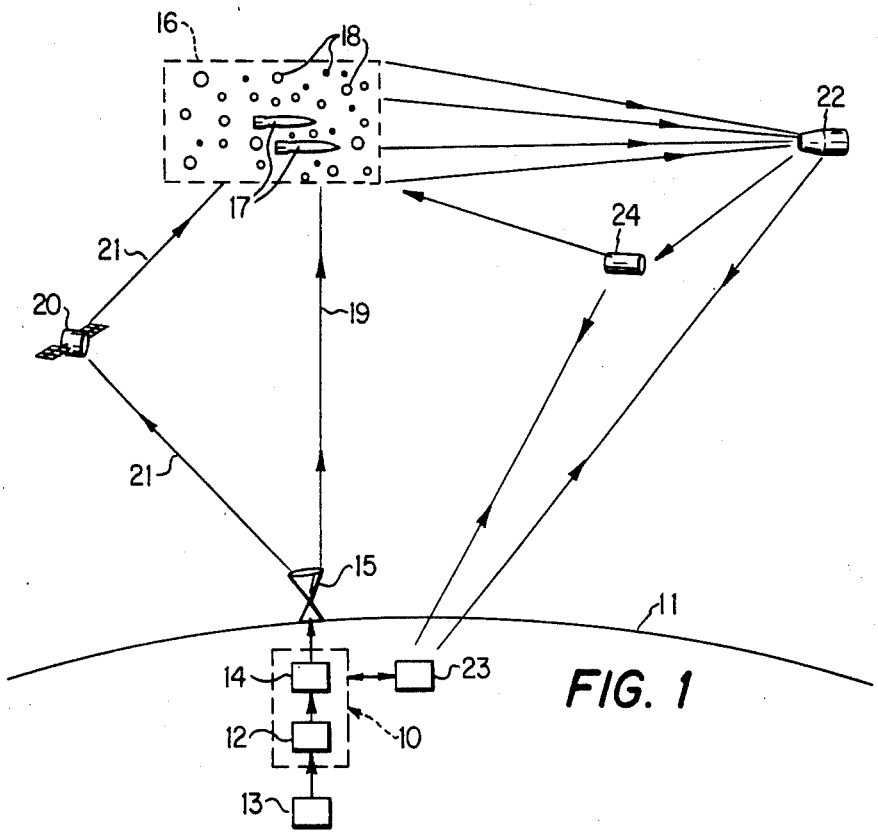
FIG. 1 is a schematical illustration of the detection and discrimination system of the present invention.

Referring more particularly to the drawings, the basic components of the defense system of the present invention is schematically illustrated in FIG. 1. Ground facilities 10 are constructed at a selected strategic geographical location on the earth's surface 11. Facilities 10 includes one or more electricity generators 12 which are powered by fuel source 13. The various components will be discussed is greater detail below. The electricity generated by generators 12 drive transmitters 14 which, in turn, generate electromagnetic radiation at a wide range of discrete frequencies, e.g., from about 1 to about 2,000 Megahertz (MHz) depending on the particular embodiment of the concept.

The electromagnetic radiation from transmitters 14 is fed to one or more separate antennae 15 which, in turn, focus this energy onto threat cloud 16 which contains a large number of objects, i.e., armed vehicles 17 and unarmed decoys and penetration aids 18. The antennae system will be spread out over a large area (10's of kilometers) and most probably consist of phasable elements. The orientation and phasing of the antennae system will then determine the location at which the focused electromagnetic fields will exceed the conditions necessary for particle energization. At other locations in the path of the em radiation, the fields will be too weak to result in acceleration. As will be further explained below, the electromagnetic radiation will energize the ambient plasma in the threat cloud or the outgassing products from the objects to create relativistic electrons around the objects. Propagation of the radiation energies may be directly from antennae 15 through the ionosphere (line 19) or through one or more relay satellites 20 (lines 21) which may either reflect or re-beam the ground generated radiation.

The relativistic electrons interact with the objects which produce very unique x-ray and/or gamma ray signatures which only come from the heavy armed, re-entry vehicles 17 as will be explained below. As shown, detector means 22 is positioned at distances of from 10 to 1000 kilometers (Kms) from the threat cloud 16 but in some instances, the detector means may be mounted directly on close-in weapon platforms. Detector means 22, scans the threat cloud 16 and picks up and pinpoints each object emitting a signature representative of an armed vehicle 17. Detector means 22 ignores the other objects 18 in the threat cloud. Also, the counting rate for the expected x-ray and gamma ray signals (i.e., photons) are high enough to exceed the nuclear background by a comfortable margin. Once re-entry vehicles 17 are identified, this information is passed from detector means 22 to a battle management system 23 or to a weapons platform 24 for further defensive action. Now that the overall aspects of the present defense system have been described, a more detailed description of the components and operation of the system will now be discussed.

A large amount of power (e.g., up to $10^{12}$ watts) in continuous or pulsed power for finite periods of time will be required for implementing the present invention. Generation of the needed power is within the state of the art. Although the electrical generators 12 necessary for the practice of the invention can be powered by any known fuel source 13, for example, by nuclear reactors, hydroelectric facilities, hydrocarbon fuels, and the like, this invention, because of its very large power requirement in certain applications, is particularly adapted for use with certain types of fuel sources which naturally occur at strategic geographical locations on the earth. For example, large reserves of hydrocarbons (oil and natural gas) exist in Alaska and Canada. In Northern Alaska, particularly the North Slope region, large reserves are currently readily available. Alaska and Northern Canada also are ideally located geographically for the placement of the present defense system. Thus, in Alaska, there is a unique combination of large, accesssible fuel sources at a very desirable defense location.

Further, a particularly desirable fuel source for the generation of very large amounts of electricity is present in Alaska in abundance, this source being natural gas. The presence of very large amounts of clean-burning natural gas in Alaskan latitudes, particularly on the North Slope, and the availability of magnetohydrodynamic (MHD), gas turbine, fuel cell, electrogasdynamic (EGD) electric generators which operate very efficiently with natural gas provide an ideal power source for the unprecedented power requirements of certain of the applications of this invention. For a more detailed discussion of the various means for generating electricity from hydrocarbon fuels, see "Electrical Aspects of Combustion", Lawton and Weinberg, Clarendon Pres, 1969.

Put another way, in Alaska, the right type of fuel (natural gas) is naturally present in large amounts and at just the right location for the most efficient practice of this invention, a truly unique combination of circumstances. Electricity from generators 12 is supplied to power the transmitters 14 to generate microwave or radio frequency (r.f.) energy which is transmitted by antennae 15. Antennae 15 may be of any known construction for high directionality, for example, a phased array, beam spread angle ($\theta$) type. See "The MST Radar at Poker Flat, Alaska", Radio Science. Vol. 15, No. 2, March-April 1980, pps. 213–223, which is incorporated herein by reference. However, it is well understood by those knowledgeable in the art that the actual design of any particular antennae will depend, in part, on the frequency of electromagnetic (em) radiation (e.g., H.F.-U.H.F.) to be used.

To create the required relativistic electrons (i.e., electrons whose mass is increased due to high velocities) within thread cloud 16, the electrons in the ambient plasma or outgassing products therein have to be excited or accelerated to energies above 5 MeV (million electron volts) (e.g., 20 MeV). The energy threshold is determined by the range of electrons in various materials and by the radiation yield of various materials. Above 5 Mev, electrons penetrate to the interior of the object under observation and the signature can only be masked by the inclusion of heavy radiation shielding. Such shielding is impractical for decoys because it exerts a tremendous weight penalty on the ICBM boost system. The radiation yield increases significantly above 5 MeV and it is therefore desirable to accelerate electrons to the ~10–50 MeV range where a broad peak in yield exists. To be effective in the present invention, the electrons will need to be accelerated to the required energies in an extremely short distance on the order of or shorter than 10 to $10^4$ meters. To effect such quick and efficient acceleration of the electrons, several techniques are available for transmitting electromagnetic radiation from the ground-based transmitters to interact with electrons which intercept the threat cloud. These include:

(1) Cylotron Resonance Acceleration (CRA) which utilizes the interaction of an em wave with the plasma electrons. The transmitted radio-frequency radiation produces time-varying fields (electric and magnetic) and the electric field accelerates the electron. For a more detailed description of the physical phenomenum involved in the technique, see "Controlled Thermonuclear Reactions", Glasstone and Lovberg, D. Van Nostrand Company, Inc., Princeton, N.J., 1960.

(2) Surfatron acceleration which creates an electrostatic wave perpendicular to the magnetic field. The electrons trapped in the wave see an electric field which accelerates them across the wave front. As long as the electrons cannot "detrap" themselves, the resulting acceleration will be limited only by the size of the wavefront. For a further discussion of surfatron, see "dc Acceleration of Charged Particles by an Electrostatic Wave Propagation Obliquely to a Magnetic Field", Sugehata et al., PHYSICAL REVIEW LETTERS, Vol. 52, No. 17, Apr. 23, 1984, pg. 1500.

(3) Beat Acceleration (BA) relies on "beating" two em waves of different frequencies to generate a high phase velocity electrostatic wave. This wave will trap and accelerate electrons until they get out of phase with the wave. For a further discussion of BA, see "Excitation of Plasma Waves in the Laser Beat Wave Accelerator"; Tang et al., Appl. Phys. Letter 45, 15 Aug. 1984, pg. 375.

(4) Plasma Wake Acceleration (PWA) uses one frequency wave in the form of a wave packet. The em wavepacket of half the plasma wavelength resonantly excites the plasma wave. The em packets are repeated at timed intervals to produce a strong wave. For further description of PWA, see "Forward Raman Instability and Electron Acceleration", Joshi et al., PHYSICAL REVIEW LETTERS, Vol. 47, No. 18, Nov. 2, 1981, pg. 1285.

While one or a combination of the above acceleration techniques may be used for creating the required relativistic electrons, the accessibility of the transmitted em energy to the interaction region must be considered. As set forth above, the em energy can be transmitted to the interaction region (threat cloud 16) directly from the ground based transmitters, through satellites borne mirrors 20, or a combination of both. The em energy should be transmitted to the interaction region with minimal losses which will depend on the selected antennae configuration, the location of the interaction region, and the required frequency of the transmitted energy. In general, high frequencies (e.g., above 10 MHz) have the advantage of avoiding problems with accessibility or unwanted D-region absorption. Unwanted nonlinear backscattering or absorption processes with power thresholds can be avoided by using different propagation paths to the interaction region for part of the necessary power.

Once the electrons in threat cloud 16 are accelerated to relativistic velocities, the relativistic electrons interact (impact) with the objects 17 and 18 in the threat cloud to produce discriminating signatures. These signatures are based on the mass per unit area of an object. That is, the x-ray flux generated by these interaction (i.e., that detected by detector means 22) is roughly proportional to the mass per unit area of the material from which the object is constructed. In addition, the x-ray spectrum is sensitive to the presence of heavy and high atomic weight (Z) elements found only in armed, re-entry vehicles 17. These factors would require a very, if not prohibitive, high weight and cost penalty to construct a decoy or penetration aid which would simulate a signature similar to a re-entry vehicle.

The interaction of the relativistic electrons with heavy, high Z objects (armed vehicles) will produce high energy Bremsstrahlung (i.e., continuous radiation emitted by charged particles, namely electrons, as a result of deflection by Coulomb fields or other particles) which is quite susceptible to detection by suitably designed gamma ray and/or x-ray detector telescopes (detector means 22). Lightweight, low Z balloons and decoys will produce little or no such signals and accordingly are effectively ignored by detectors 22.

More specifically, detectors means 22 is preferably a photon-counting telescope of the type which detects high energy photons even in an environment dominated by background prompt and residual radiation from a large number of nuclear bursts to discriminate between the radiation (i.e., signatures) from reentry vehicles and that from unarmed objects. Further, to determine the direction from which an incidental photon came, the detectors must be capable of some degree of angular resolution. The resolution of the detector is determined by distance to the threat cloud. To locate an object within a ten meter sphere, the resolution must be better than $\Delta\theta = 10^{-2}/R$ where R is the distance between the object and the detector in Kms. For detectors at ranges of 1000 km $\Delta\theta \lesssim 10\mu$ radians. The Bremsstrahlung photons, coming from signatures produced by interaction of the relativistic electrons with an object, will be uniformly spread from zero to the maximum energy of the relativistic electrons. However, the energy threshold detector of detector means 22 will be set at energy level equal to the minimal valves of the signatures expected from the armed vehicles and will only detect and analyze those signatures at or above this threshold energy level. Therefore, detector means 22 will quickly detect and pinpoint vehicles 17 (high energy signatures) while ignoring objects 18 (low energy signatures, if any) in the threat cloud.

As a further explanation of how the interaction of the relativistic electrons generate or produce identifying signatures from the objects, consider the following example. A 20 MeV electron has a range in matter of about 10 gm/cm$^2$. The "thickness" of a typical re-entry vehicle 17 is like 20 to 40 gm/cm$^2$. Thus, a relativistic electron will be stopped by the re-entry vehicle 17, converting a major fraction of its energy into photons. On the other hand, the same relativistic electron will sail through a lightweight decoy 18 or a balloon producing, relatively speaking, almost no Bremsstrahlung signal. It follows that a five-to-ten percent by weight decoy will produce a five-to-ten percent, relative to the re-entry vehicle, signal if made from high Z material. Since the decoy or balloon is mostly low Z material, the photon signal is much less since all of the electron energy is dissipated in loss to ionization.

For example, for aluminum (Z=13), the loss to radiation dominates above an energy E=61.5 MeV. For uranium (Z=92), the crossover energy is only 8.7 MeV. Thus, for lightweight, low Z decoys, the efficiency of conversion of electron energy to photons in an object is significantly less than 1 while the conversion efficiency for a re-entry vehicle with uranium is approximately 1.

Detectors 22 are located at a distance (e.g., 10–1000 km) from the cloud of relativistic electrons and should not be immersed therein.

Figure 2:
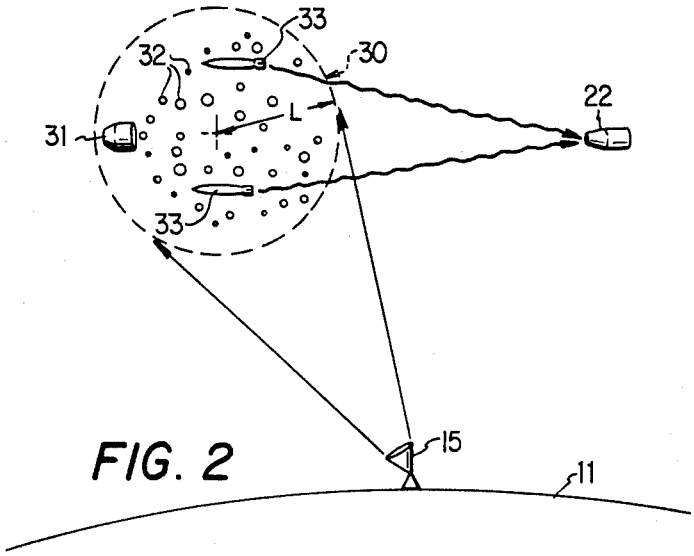
FIG. 2 is an idealized illustration of one embodiment of the present invention.

Again turning to the drawings, FIG. 2 graphically illustrates a first specific embodiment of the present invention wherein a sperical cloud 30 of relativistic electrons are created around a "bus" 31 which is deploying a number of decoys, penetration aids, balloons, chaff, etc. 32 around and in the vicinity of armed, re-entry vehicles 33. By tracking bus 30 with antennae 15, cloud 30 will move dynamically with bus 31 or its ballistic trajectory. Decoys, etc. 32 are identified on a time less than 1 second since the signature (i.e., photon flux) at detector means 22 is less than the value of the signature expected from an armed vehicle 33. Decoys 32 are thereafter ignored by the discrimination system which will continue to track only vehicles 33.

To insure that all objects will encounter relativistic electrons in cloud 30, the radius L of cloud 30 should be on the order of 1 kilometer (km) when the relative speed of the objects with respect to the speed of cloud 30 is on the expected order of $Ur \approx 1$ km/second.

Cloud 30 of relativistic electrons (5–10 MeV) is formed by energizing from $10^{-3}$ to $10^{-4}$ of the ambient plasma having an electron density ($n_e$) of from $10^4$ to $10^5$ by applying r.f. or microwaves from ground based transmitters as discussed above. The amounts of power required, confinement time, etc., can be calculated from known relationships. For example, for a baseline example where: Ur=1 km/sec; speed of object=1 km/sec; L=1 km; t=1 sec.; observing or dwell time=10 sec.; density of vehicle 33 material ($n_R$)=10 #/cm$^3$; omnidirectional flux above 5.5 MeV (F)=$10^{11}$ #/cm$^2$sec:

(a) Total energy in cloud 30=8 kilo joules
(b) Confinement time=1.6 msec
(c) Power requirement=50 to 500 MW
(d) Total energy requirement for 1–5 dwell time=-1–10 GJ.

The minimum time T for building cloud 30 can be expressed as:

$$T = e/p \text{ msec}$$

wherein:

e=total energy in cloud 30 in kJ and
P=total power requirement in GW which will normally range between 1 to 100 $\mu$ sec.

During this time, bus 31 moves a distance less than a few tens of meters. Due to the power considerations, it is desirable to use as small of cloud 30 as the focusing of the ground based energy and the acceleration length allows.

Figure 3:
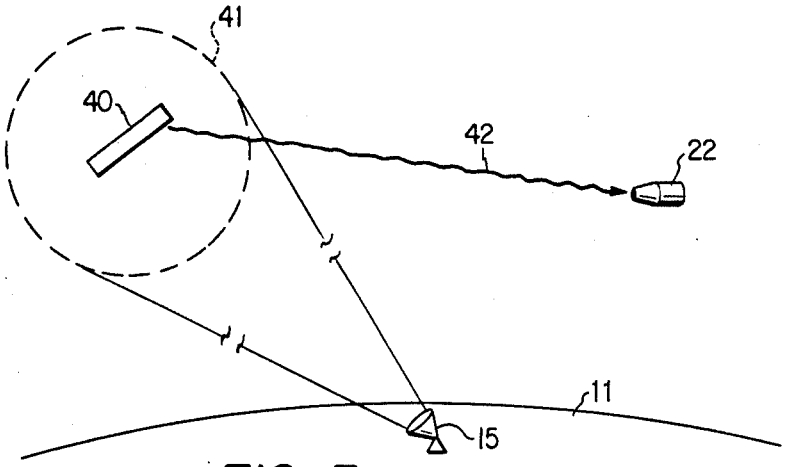
FIG. 3 is an idealized illustration of another embodiment of the present invention.

FIG. 3 illustrates a further specific embodiment of the prevent invention wherein the electrons in outgassing products from an individual object 40 are energized by ground-based energy to form cloud 41 of relativistic electrons for interaction with object 40 to produce a signature 42 therefrom. Due to the high vacuum conditions of space, all materials will inherently give off (i.e., outgas) gases which are otherwise entrapped in the material at atmospheric conditions. These gases will normally form a cloud extending to a distance of 2–20 meters around object 40 which will have an estimated particle density $N_o$ of $10^{11}$ per cubic centimeter.

In this embodiment, electromagnetic radiation from antennae 15 ionizes the outgassing products to form cloud 41 of relativistic electrons of 10 MeV. From the total relativistic electron density $N_e$ of $4\times10^{14}$, half will interact with object 40 to generate a signature 42 which is detected by detector means 22.

The total energy requirement for this embodiment to create a cloud having an 10 MeV electron density of $4\times10^{14}$ is 32 joules. In order to deliver this energy on the required time scale of $10^{-5}$ to $10^6$ seconds, the required power will be on the order of 1–5 MW.

The dwell time per object 40 will be very short. The most strenuous requirements for this embodiment are on the physics of the acceleration. Namely the acceleration length should be $Lo \approx 1$–10 m. This embodiment requires rather high frequency microwaves, since the spot size for efficient energization should be of the order of 1–4 m$^2$.

Figure 4:
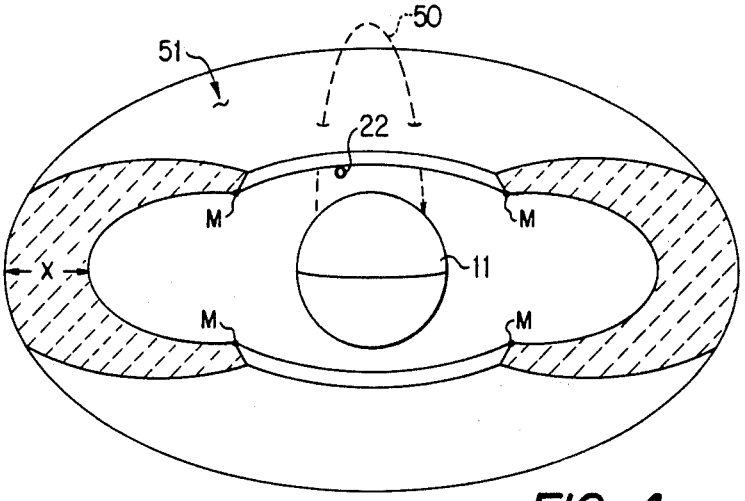
FIG. 4 is an idealized illustration of still another embodiment of the present invention.

FIG. 4 illustrates still another embodiment wherein a stationary layer or shield 51 of relativistic electrons are positioned in the path of a threat cloud (dotted line 50). Decoys and armed re-entry vehicles in the threat cloud will produce signatures dependent on their respective weight per unit area similarly as discussed above. A layer thickness X of 10 km will require $n_R = 10$ cm$^{-3}$. The stationary shield 50 requires energizing electrons at an altitude between 200–1000 km by r.f. energy from ground-based transmitters and storage in naturally-occurring radiation belts. The energization altitude will also be the mirror point M if the energy transfer is perpendicular to the magnetic field. The guiding center of the trapped electrons executes a bounce motion between the northern and southern mirror points with a bounce time $t_b \approx \cdot 2$ sec, while drifting eastward with a drift time $t_d \approx 1000$ sec. Depending on whether the layer build up time is longer than $t_d$, the layer will be diluted by forming drift shell 51. Once shield 51 is established, object 50 passing therethrough will react with the relativistic electrons in shield 41 to produce signatures which are detected by detector means 22 which is positioned below and out of shield 50.

While the present invention has been described for discriminating between armed and unarmed vehicles in a threat cloud during an impending attack, it can also be employed to "interrogate" orbiting satellites to determine if any of said satellites may be carrying nuclear weapons for future launch. Again, a cloud of relativistic electrons would be created around the satellite of interest for interaction therewith to produce a signature from that satellite which, when analyzed, would reveal the nature of the materials contained in the satellite.

What is claimed is:

1. A method of discriminating between armed, reentry vehicles and unarmed objects in space, said method comprising:

transmitting electromagnetic radiation from the surface of the earth to the vicinity of the vehicles and objects to accelerate electrons present in space to create a cloud of relativistic electrons around said re-entry vehicles and said objects;

interacting said relativistic electrons with said reentry vehicles and said objects to thereby produce individual signature signals representative of said individual re-entry vehicles and said objects; and detecting said signature signals for discriminating between said re-entry vehicles and said objects.

2. The method of claim 1 wherein said electromagnetic radiation is propagated by cyclotron resonance acceleration.

3. The method of claim 1 wherein said electromagnetic radiation is propagated surfatron acceleration.

4. The method of claim 1 wherein said electromagnetic radiation is propagated by beat acceleration.

5. The method of claim 1 wherein the electromagnetic radiation is propagated by plasma wake acceleration.

6. The method of claim 1 wherein said electrons are those situated in an inherent ambient plasma which surrounds said re-entry vehicle and said objects.

7. The method of claim 1 wherein said electrons are the products being outgassed by said re-entry vehicles and said objects.

8. The method of claim 1 including:

detecting only the signature signals from said armed, re-entry vehicles while ignoring the signatures produced by said unarmed objects.

9. The method of claim 1 wherein said electrons are accelerated to energies greater than 5 million electron volts.

10. The method of claim 8 wherein said signature signal are comprised of photons created by the interaction of said relativistic electrons with materials in said re-entry vehicles and said objects.

11. The method of claim 8 wherein photons are at a distance of at least 10–1000 kilometers from said interaction between said relativistic electrons and said reentry vehicles and said unarmed objects.

12. A defense system for detecting and discriminating between armed, re-entry vehicles and unarmed objects when in close proximity of each other in space, said defense system comprising:

means positioned on the surface of the earth for transmitting electromagnetic radiation from said surface of the earth to the vicinity of said vehicles and objects to thereby create a cloud of relativistic electrons of energies greater than 5 million electron volts around both said re-entry vehicles and said objects for interaction therewith whereby individual signature signals are produced from each object and each re-entry vehicle;

means for detecting said signature signals for identifying said re-entry vehicles from objects.

13. The defense system of claim 12 wherein said means for creating relativistic electrons comprises:

ground-based generators for generating electricity;

transmitter means powered by said electricity to generate electromagnetic radiation;

antennae means for focusing said electromagnetic radiation into said ambient plasma around said re-entry vehicles and said objects; and a power source for powering said generators.

14. The defense system of claim 13 wherein said power source comprises:

natural gas.

* * * * *

UNITED STATES PATENT AND TRADEMARK OFFICE

CERTIFICATE OF CORRECTION

PATENT NO. : 4,817,495

DATED : April 4, 1989

INVENTOR(S) : Adam T. Drobot

It is certified that error appears in the above-identified patent and that said Letters Patent is hereby corrected as shown below:

Column 10, line 15, after "photons are", insert ---detected---.

Signed and Sealed this

Twenty-eighth Day of November 1989

*Attest:*

JEFFREY M. SAMUELS

*Attesting Officer* *Acting Commissioner of Patents and Trademarks*